US005380614A

United States Patent [19]

Totsuka et al.

[11] Patent Number: 5,380,614

[45] Date of Patent: Jan. 10, 1995

[54] POSITIVE CHARGEABLE COLOR TONER

[75] Inventors: Hiroki Totsuka; Hirono Takeuchi, both of Shizuoka, Japan

[73] Assignee: Tomoegawa Paper Co., Ltd., Tokyo, Japan

[21] Appl. No.: 31,548

[22] Filed: Mar. 15, 1993

[30] Foreign Application Priority Data

Apr. 2, 1992 [JP] Japan ..... 4-108435
Apr. 17, 1992 [JP] Japan ..... 4-122966

[51] Int. Cl.[6] ..... G03G 9/08; G03G 9/09
[52] U.S. Cl. ..... 430/106; 430/110
[58] Field of Search ..... 430/106, 110

[56] References Cited

U.S. PATENT DOCUMENTS 4,828,954 5/1989 Hashimoto et al. ..... 430/110
5,037,717 8/1991 Ishii et al. ..... 430/110
5,176,979 1/1993 Eguchi et al. ..... 430/110
5,202,209 4/1993 Winnik et al. ..... 430/110 X

FOREIGN PATENT DOCUMENTS 149057 6/1989 Japan ..... 430/110
20878 1/1990 Japan ..... 430/110
66654 3/1990 Japan ..... 430/110

*Primary Examiner*—Roland Martin
*Attorney, Agent, or Firm*—Thompson, Hine & Flory

[57] ABSTRACT

The present invention provides a positive chargeable color toner wherein to the surfaces of coloring particles comprising binding resin, coloring agent and charge control agent as the main ingredients, is fixed a positive chargeable compound in the amount of 0.1~10.0 parts by weight per 100 parts by weight of the coloring particles.

10 Claims, 2 Drawing Sheets

POSITIVE CHARGEABLE COLOR TONER

BACKGROUND OF THE INVENTION

1. Field of the Invention

The present invention relates to a positive chargeable color toner for developing electrostatic latent images in processes such as electrophotography, electrostatic recording and the like.

2. Relevant Art

Heretofore, nigrosine dyes are mainly being used as the charge control agent employed in positive chargeable toners for use in electrostatic load developing. However, although nigrosine dyes can be used in black colored toners because of their dark brown color, they are not appropriate for use in, for example, yellow, cyanogen, and magenta colored toners; as the charge control agent for use in color toners, colorless quaternary ammonium salt has been generally used. However, with this colorless quaternary ammonium salt there exist disadvantages such as poor dispersibility in regards to binder resin, and inferior charging properties when compared with nigrosine dyes.

As the binding resin for use in color toners, polyester resins, due to their superior light transparency and color stacking abilities, are preferably being employed. However, there exist problems in controlling charging properties since prior art charge control agents of quaternary ammonium salts and the like are affected by acid groups and hydroxy groups included in the aforementioned resins, resulting in unstable charging properties.

In addition, as the coloring agent for use in color toners, xanthene-type magenta colored dye, quinacridone-type magenta colored pigment, disazo-type yellow pigment, phthalocyanine-type cyanogen colored pigment and the like are known. These coloring agents are essential in color control of color toners, however, the charging properties vary according to the effects of their chemical structure, and thus these coloring agents do not always affect the positive chargeable toner in an ideal manner.

Furthermore, fluidity must also be among the characteristics of the toner, and in order to achieve this one or more types of fluidization agents are applied to the surface of the toner. Heretofore, as the fluidization agent for this toner, colloidal silica is being used. However, due to the strong intrinsic negative charging properties possessed by colloidal silica, when a positive chargeable toner employing colloidal silica is mixed inside a developing machine, there exist problems such as loss of the toner's original positive charging properties, fogging during developing, scattering of the toner, and accumulation of fluidization agent in the developer leading to reduction of the developer life span.

SUMMARY OF THE INVENTION

The objective of the present invention is to provide a color toner which solved the above mentioned problems in the prior art color toners, stemming from structural components such as positive charge control agents of quaternary ammonium salts, polyester resins, coloring agents for use in color toners, fluidization agents, and the like. Through the color toner of the present invention which possesses superior positive charging properties, a large number of copy sheets can be obtained without the existence of problems created by non-uniform positive charging properties such as lowering of image density, increase in fog density and scattering of the toner.

An aspect of the present invention is directed to providing a positive chargeable color toner comprising (a) a positive chargeable compound and (b) coloring particles including a binding resin, a coloring agent and a charge control agent as main ingredients, the coloring particle having a surface, wherein to the surfaces of the coloring particles, is fixed the positive chargeable compound in the amount of 0.1~10.0 parts by weight per 100 parts by weight of said coloring particles.

The above objects, effects, features, and advantages of the present invention will become more apparent from the following description of preferred embodiments thereof.

DETAILED DESCRIPTION OF THE INVENTION

Figure 1:
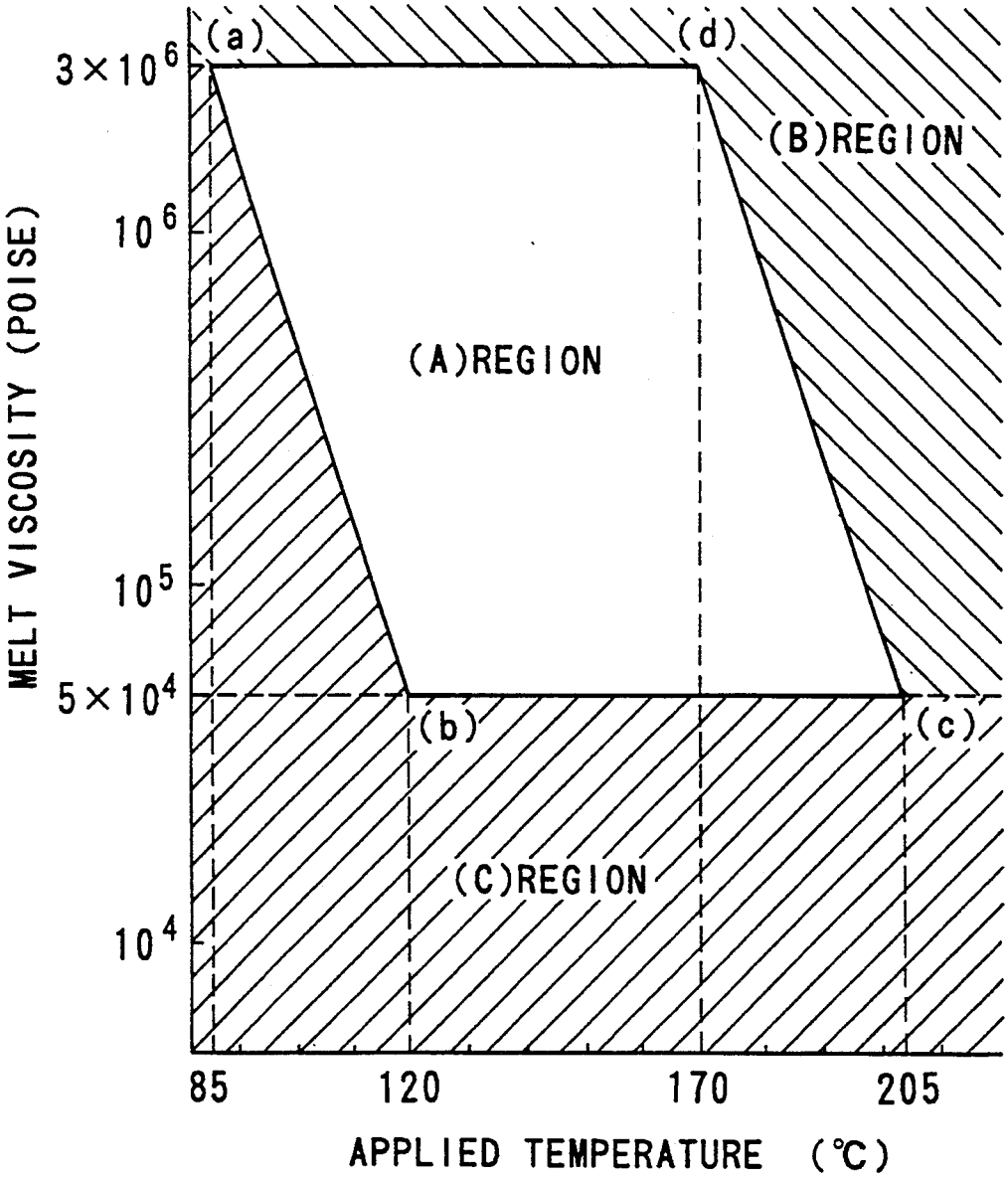
FIG. 1 is a graph showing the melt viscosity characteristics of a resin particle.

The present invention provides a positive chargeable color toner characterized in having fixed onto the surface of coloring particles comprising a binding resin, coloring agent and charge control agent as its main ingredients, a positive chargeable compound in the amount of 0.1~10.0 parts by weight per 100 parts by weight of the aforementioned coloring particles. This positive chargeable compound is either alumina particle possessing the number of molecules of $CO_2$ gas adsorbed thereby (hereafter, referred to as "a $CO_2$ gas adsorption number") of 4.0/nm$^2$ or less, and a specific surface area of 80 m$^2$/g or greater according to Brunauer Emett Teller equation (hereafter, referred to as "the BET equation") which has been treated using a silane coupling agent; or positive chargeable resin particle possessing thermoplasticity and an average particle size of 0.05~2.0 μm.

The alumina particle used in the present invention is a micro particle of alumina possessing a $CO_2$ gas adsorption number of 4.0/nm$^2$ or less and a specific surface area of 80 m$^2$/g or greater according to the BET equation, which was formed by means of hydrolyzing anhydrous aluminum chloride at high temperatures (flame): the surface of this particle has been treated using a silane coupling agent. The range limits specifying the $CO_2$ gas adsorption number and specific surface area according to the BET equation according to the present invention, may be adjusted by selecting as the alumina micro-particle to form the nucleus, a small particle with a diameter of approximately 40 μm or less, and may also be adjusted as well by adjusting the amount of alumina particles to be treated in response to nature of the silane coupling agent. "Aluminum Oxide C" produced by Nippon Aerosil Co., Ltd. is commercially available as the alumina micro-particle to form the nucleus. As the silane coupling agent there can be mentioned dimethyl silicone, methyltrimethoxysilane, (3-aminopropyl) trimethoxysilane, (3-aminopropyl) triethoxysilane, {3-(2-aminoethoxyamino)propyl} triethoxysilane, {3-(2-aminoetoxyamino)propyl} trimethoxysilane, $C_8F_{17}SO_2NC_2H_5(CH_2)_3Si(CH_3O)_3$ and the like; however, the silane coupling agent is not, in particular, limited to the aforementioned. From the above list, particularly stable positive charging properties may be obtained using dimethyl silicone and $C_8F_{17}SO_2NC_2H_5(CH_2)_3Si(CH_3O)_3$, thus these compounds are preferred.

In the present invention, a high precision automatic gas adsorption apparatus (produced by Japan Bell under the licensed name BELSORP 28) readily available on the market is used to measure the $CO_2$ gas adsorption number and specific surface area according to the BET equation of the alumina particle. In this case, the specific surface area according to the BET equation is measured using the inert gas $N_2$ as the adsorption gas. Concretely, after the necessary adsorption amount Vm (cc/g) for forming a monolayer on the surface of the alumina particle is measured, the specific surface area S ($m^2/g$) can be found using the following formula.

$$S=4.35\times Vm(m^2/g)$$

In addition, after measuring the adsorption amount of the $CO_2$ gas, the $CO_2$ gas adsorption number can then be found using the following formula.

$$CO_2 \text{ gas adsorption number (per nm}^2) = \frac{CO_2 \text{ gas adsorption amount} \times 6.02 \times 10^{23}}{22414 \times \text{specific surface area} \times 10^{18}}$$

When an alumina particle having a $CO_2$ gas adsorption number greater than $4.0/nm^2$ is fixed onto the surface of a coloring particle, under both the environmental conditions of normal-temperature/normal-humidity (25° C./60% RH) and low-temperature/low-humidity (10° C./20% RH), the frictional charge amount rises during agitation in the developing machine causing reduction of the image density. In addition, under the environmental conditions of high-temperature/high-humidity (35° C./85% RH), due to adsorption of free water, the frictional charge amount lowers and problems such as increase in fog density and scattering of the toner occur.

In the case when an alumina particle having a specific surface area according to the BET equation of less than 80 $m^2/g$ is fixed onto the surface of a coloring particle, cohesion of the positive chargeable color toner occurs easily since the ability of the alumina particle to function as a fluidization agent is small.

The coloring particle according to the present invention is obtained by first dry blending the binding resin, coloring agent and charge control agent, adding as necessary additives to form a desired composition. This mixture is melted and kneaded using an extruder, roll mill or the like, and the bulk material obtained is then pulverized using a mechanical pulverizing device such as a jet mill, and classified to yield a particle with an average particle diameter of 2~15 μm. In addition, it is also possible to obtain the coloring particle by processes other than the melting-kneading process stated above, such as by polymerization. In other words, the aforementioned coloring agent and other necessary additives are added to the monomer to form the binding resin, followed by either mixed-dispersing or dissolving of the resultant mixture to form the polymerization composition. This polymerization composition is then polymerized, and the coloring particle is formed. In this case, as the method for polymerizing the monomer, suspension polymerization, emulsion polymerization and the like may be employed accordingly. As well, in the polymerization, it is also possible to add such ingredients as a polymerization initiator, cross-linking agent, polymerization catalyst, polymerization stabilizer and the like to the polymerization composition when necessary.

In regards to the binding resin used in the coloring particle of the present invention, any resin that can be generally used as a binding resin in a dry-type toner for use in electrophotography is applicable. Such resins include but are not limited to polyester resin, styrene resin, acrylate resin, styrene-acrylate copolymer resin, vinyl chloride resin, vinyl acetate, vinylidene chloride resin, phenol resin, epoxy resin, thermoplastic epoxy resin, polypropylene resin, polyethylene resin and the like: these resins can be used alone or as a mixture thereof in a range which will not hinder the light transparency of the color toner.

In the present invention, because stable positive charging properties can be obtained by using the aforementioned alumina particle or positive chargeable resin particle, even among the aforementioned binding resins, use of a polyester resin with superior light transparency and color stacking ability is preferred.

As the aforementioned polyester resin any condensation polymer formed from an alcohol and a carboxylic acid can be suitably employed, however the polyester resin is not in particular limited to the aforementioned.

As the alcohol there can be mentioned diols such as ethylene glycol, diethylene glycol, triethylene glycol, 1,2-propylene glycol, 1,3-propylene glycol, 1,4-butanediol, neopentyl glycol, 1,4-butenediol, and the like, 1,4-bis(hydroxymethyl) cyclohexane, etherificated bisphenols such as bisphenol A, polyoxymethylenated bisphenol A, polyoxyethylenated bisphenol A, polyoxypropylenated bisphenol A, and the like, as well as other bivalent alcohol monomers.

Additionally, as the carboxylic acid there can be mentioned maleic acid, fumaric acid, mesaconic acid, citraconic acid, iraconic acid, glutaconic acid, phthalic acid, isophthalic acid, terephthalic acid, cyclohexane dicarboxylic acid, succinic acid, adipic acid, sebacic acid, malonic acid, as well as their anhydrates and dimers formed of lower alkylesters and linolenic acids, and other bivalent organic acid monomers.

The polyester resin used in the present invention is not just limited to polymers formed by the aforementioned bifunctional monomers, as it is also possible to use polymers incorporating components formed by multi-functional monomers having three or more functionalities. As the multi-valent alcohol monomer possessing three or more valencies which serves s this multi-functional monomer, there can be mentioned sorbitol, 1,2,3,6-hexane tetrol, 1,4-sorbitane, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and the like.

In addition, as the multi-valent carboxylic acid monomer possessing three or more valencies, there can be mentioned 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-napthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetratricarboxylic acid, and their anhydrates.

Further, it is preferred that the component formed by the multi-functional monomers having three or more functionalities be incorporated into each alcohol or acid component, the structural units of the polymer, in a molar ratio of 30~80%.

In regards to the coloring agent used in the coloring particle of the present invention, any colored dye or pigment that can be generally used as a coloring agent in a dry-type toner for use in electrophotography is applicable. As this coloring agent there can be mentioned rhodamine-type magenta dye, quinacridone-type magenta pigment, phthalocyanine-type cyanogen pigment, phthalocyanine-type green pigment, disazo-type yellow pigment, monoazo-type red pigment, anthraquinone-type dye and the like. It is preferred that the usage amount of the above mentioned be 2~15 parts by weight per 100 parts by weight of the binding resin. If the usage amount is less than 2 parts by weight, the color of the toner image becomes insufficient, while on the other hand, if the usage amount exceeds 15 parts by weight the fixing ability of the; toner becomes poor, both of which are undesirable.

In addition, as the charge control agent used in the coloring particle, colorless to slightly colored charge control agents with positive charging properties used in the prior art can be suitably used, however generally quaternary ammonium salts are employed. As concrete examples of quaternary ammonium salts there can be mentioned commercially available products such as "Bontron P-51" and "Bontron AFP-B" produced by Orient Chemical Industries Co. Ltd., "TP-302" and "TP-415" produced by Hodogaya Chemical Industries Co. Ltd., and the like.

Furthermore, as the additives to be added to the coloring particle as necessary, there can be mentioned low molecular weight polypropylenes, low molecular weight polyethylenes and the like which serve as offset inhibitors.

In addition, the positive chargeable resin particle with thermoplasticity according to the present invention is a colorless to slightly colored micro-particle obtainable by suspension polymerization, emulsification polymerization and the like which has an average diameter of 0.05~2 μm wherein a polar group possessing positive charging properties has been introduced into a thermoplastic resin ingredient such as styrene-acrylate resin, polyester resin, low molecular weight polypropylenes and the like. In this case, in order to impart the positive charging properties to the resin particle, the present invention may employ a step in which various polar groups such as amino groups, amido groups and the like are introduced into the resin body itself. Other methods for imparting the positive charging properties to the resin particle include polymerization of a positive charge control agent such as aliphatic metal salts, quaternary ammonium salts, aminoiminoisoindolinine, and the like with the aforementioned thermoplastic resin, or by melting and kneading a thermoplastic resin and a colorless positive charge control agent followed by pulverization and classification. Furthermore, in order to prevent loss of the color of the color toner, it is preferred that the positive charge control agent in this case be colorless or slightly colored. In the present invention, if the average particle diameter of the positive chargeable resin particle is less than 0.05 μm, the dispersibility with the coloring particles is poor due to strong adhesive properties, while on the other hand, if the average particle diameter exceeds 2 μm, it becomes difficult to uniformly fix the resin particles to the coloring particles.

In the present invention, the melt viscosity characteristics of the resin particle at the time of measuring with an overhead-type flow tester were as shown in FIG. 1, and the relationship between the applied temperature and melt viscosity was as follows: (a) $3\times10^6$ POISE at 85° C., (b) $5\times10^4$ POISE at 120° C., (c) $5\times10^4$ POISE at 205° C., and (d) $3\times10^6$ POISE at 170° C. It is preferred that the resin particle have melt viscosity characteristics inside the region (parallelogram) designated by the lines connecting (a), (b), (c) and (d), in other words, the (A) region as shown in FIG. 1. Resin particles of the (B) region possessing higher melt viscosity characteristics than that of the aforementioned (A) region, are difficult to fix to the coloring particles due to their high melt viscosities. In addition, the dispersed state, in relation to the coloring particles, of lo resin particles of within the (C) region possessing lower melt viscosity characteristics than those of the (A) region, is poor due to the strong cohesive properties of these resin particles, and this resulted in non-uniform fixing of the resin particles to the surface of the coloring particles.

The positive chargeable color toner of the present invention is obtained by fixing the aforementioned positive chargeable compound formed from alumina particles or positive chargeable resin particles to the surfaces of the color particles.

Figure 2A:
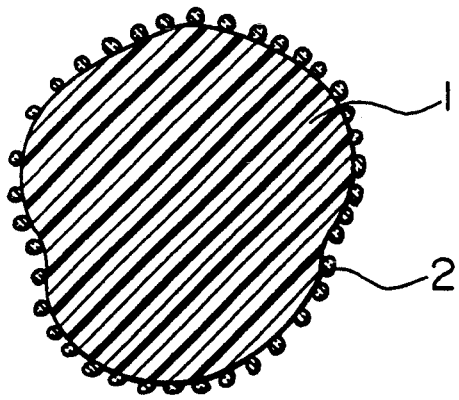
FIG. 2(A) is a cross-sectional view of a toner particle, showing a state in which a positive chargeable compound has been adhered to the surface of coloring particles using a Henschel mixer.

A method for fixing these alumina particles to the surfaces of the coloring particles exists in which a mixed powder consisting of alumina particles as a positive chargeable compound 2 dispersed and adhered to the surfaces of coloring particles 1 as shown in FIG. 2(A) is formed by means of a Henschel Mixer and the like. This mixed powder is then placed in a surface reformer (such as "Nara hybridization system" produced by Nara Machinery Co., Ltd. and "Ang Mill" produced by Hosokawa Micron Corporation), compression force and frictional force are applied to the composite powder mixture (from henceforth referred to as "surface reforming process"), and the alumina particles are fixed to the surfaces of the coloring particles in a manner such that at least one portion of the alumina particles covers the aforementioned surface, as shown in FIG. 2(B).

In this case, the mix ratio of the alumina particles to the coloring particles is 0.1~10 parts by weight per 100 parts by weight of the coloring particles. If the amount of the alumina particles is less than 0.1 parts by weight, toner particles possessing superior positive charging properties cannot be obtained. On the other hand, if the amount exceeds 10 parts by weight, the positive charging properties of the toner particles are in excess. In other words, the charging amount is excessive resulting in an insufficient image density. Additionally, because the alumina particles in this case easily revert back to possessing their former negative charging properties during mixing and agitation inside the developing machine, fogging and scattering of the toner occur, resulting in reduction of the developer life span.

In the following, the manner in which the aforementioned positive chargeable resin particles are fixed to the surfaces of the coloring particles will be described. In the present invention, in order to fix the resin particles to the surfaces of the coloring particles, as shown in FIG. 2(A), resin particles as a positive chargeable compound 2 are scattered and adhered to the surfaces of coloring particles 1 using a mixer such as a Henschel Mixer. In this case, the mix ratio of the resin particles to the coloring particles is 0.1 ~ 10 parts by weight per 100 parts by weight of the coloring particles. If the amount of the resin particles is less than 0.1 parts by weight, superior positive charging properties cannot be obtained following fixing. On the other hand, if the amount of the resin particles exceeds 10 parts by weight, the positive charging amount is excessive following fixing.

Figure 2B:
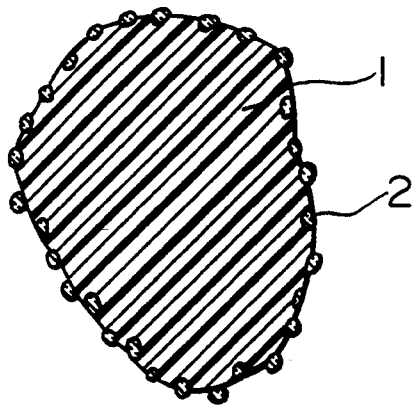
FIG. 2(B) is a cross-sectional view of a toner particle, showing a state in which a positive chargeable compound is fixed to the surface of coloring particles following surface reformation treatment.

The mixed powder consisting of resin particles dispersed and adhered to the surfaces of coloring particles is then placed in a surface reformer (such as "Nara hybridization system" produced by Nara Machinery Co., Ltd. and "Ang Mill" produced by Hosokawa Micron Corporation), compression force and frictional force are applied to the composite powder mixture (from henceforth referred to as "surface reforming process"), and the resin particles 2 are fixed to the surfaces of the coloring particles 1 forming a layer as shown in FIG. 2(B).

In this manner, the resin particles previously imparted with positive charging properties are fixed to the surfaces of the coloring particles resulting in uniform charging properties being imparted to the coloring particles, thus solving problems such as fogging and toner scattering caused by the aforementioned low or non-uniform charging properties.

When developing using the positive chargeable color toner of the present invention, a carrier generally used in electrophotography is first mixed in with the color toner forming a two-component developer which is then ready for use.

In regards to the carrier used in the present invention, any carrier generally used in electrophotography may be employed, however, a ferrite carrier covered by a silicon resin (silicon coat) is preferred. Besides this silicon coat, ferrite carriers with fluorine resin coats are known to serve as carriers used generally with positive chargeable developers, however in this case, although high charging properties are obtained, drawbacks exist such as problems with the fluidity of the developer and degradation of the developing properties, in particular, during continuous copying. In regards to these points, silicon-coated carriers are advantageous since they possess superior fluidity and since the above mentioned degradation occurs rarely with their use. In color toners employing only prior art quaternary ammonium salt as the charge control agent, it is very difficult to obtain sufficient charging properties when combined with silicon-coated carriers. However, with the positive chargeable color toner of the present invention, superior charging properties are obtainable when coined with silicon-coated carriers.

As mentioned above, it is preferred that the carrier for use in the two-component developer employed in the present invention be a ferrite carrier covered by a silicon coat. This is because when these carriers are combined with the toner according to the present invention, superior charging properties are obtainable, and longevity of the developer becomes possible. In addition, in order to obtain a high image quality, a carrier current value of 0.2 ~ 2.0 μA is preferred. If this value is less than 0.2 μA, although the line and fine line image qualities are superior, there exist disadvantages such as low image density of solid portions and strong resulting edge images. On the other hand, if the value exceeds 2.0 μA, problems occur such as degradation of the image quality and excessive consumption of the toner from toner overdeveloping.

In the method for measuring this carrier current value, only the carrier is placed in the developing machine and instead of a photo-sensitive element, an aluminum drum is used. The gap between this aforementioned aluminum drum and developing sleeve is then adjusted to 4 mm and, at the time of applying a voltage of 200 V to the developing sleeve the current flowing into the aluminum drum, which equals the carrier current value, is measured.

In the present invention, a fluidization enhancement agent may be adhered when necessary to the surface of the positive chargeable toner particle obtained in above described manner. When necessary, colorless materials such as hydrophobic alumina particles, hydrophobic silica and the like which do not affect the color of the color toner may be used as the fluidization enhancement agent. As the means for adhering this fluidization enhancement agent to the color toner, there can be mentioned conventional agitators such as a paddle mixer, turbine mixer, Henschel mixer and the like. In addition, surface reformers such as "Nara Hybridization System" produced by Nara Machinery Co., Ltd. and "Ang Mill" produced by Hosokawa Micron Corporation may also be suitably employed.

EXAMPLES

In the following, the present invention will be explained with reference to the examples.

EXAMPLE 1

| Materials: | |
|---|---|
| Thermoplastic polyester resin (NCP-001V produced by Japan Carbide Industries Co., Ltd.) | 100 parts by weight |
| Xanthene-type rhodamine dye (Oil Pink 312 produced by Orient Chemical Industries, Ltd.) | 10 parts by weight |
| Quaternary ammonium salt (Bontron P-51 produced by Orient Chemical Industries, Ltd.) | 2 parts by weight |
| Polypropylene (Viskol 660P produced by Sanyo Chemical Industries Co. Ltd.) | 5 parts by weight |

After mixing the above-described materials in a super mixer, the mixture was melted and kneaded using an extruding machine. After cooling, this kneaded mixture was then pulverized and classified using a jet mill and wind force classifier to produce coloring particles (α) with an average particle diameter of 8.5 μm.

The composition below was mixed for 5 minutes at 2000 rpm using a 20 liter Henschel mixer, and a mixed powder formed by adhering alumina particles to the surfaces of coloring particles (α) was manufactured. Furthermore, the alumina particle in the composition below was surface-treated using a coupling agent formed of 1.25 parts by weight of dimethyl silicone and 2.5 parts by weight of $C_8F_{17}SO_2NC_2H_5(CH_2)_3Si(CH_3O)_3$ per 100 parts by weight of alumina micro-particles ("Aluminium Oxide C" produced by Nippon Aerosil Co., Ltd. ) so that the alumina particles possessed a $CO_2$ gas adsortion number of 3.3/nm$^2$ and a specific surface area of 87 m$^2$/g according to the BET equation.

| Composition: | |
|---|---|
| Coloring particles (α) | 100 parts by weight |
| Alumina particles | 0.5 parts by weight |

The mixed powder obtained by the aforementioned operation was then processed for 3 minutes at 6400 rpm using an "NHS-1-type Nara hybridizer" produced by Nara Machinery Co., Ltd., and toner particles processed by surface reforming wherein alumina particles are fixed to the coloring particle surfaces were manufactured. Furthermore, 0.4 parts by weight of hydrophobic silica (product name: R-972 produced by Nippon Aerosil Co., Ltd. ) was added per 100 parts by weight of the toner particles, and this mixture was then agitated for 1 minute at 3000 revolutions per minute using a 10 liter Henschel mixer. In this manner, silica particles were adhered to the surfaces of the toner particles producing a positive chargeable color toner according to the present invention.

EXAMPLE 2

A positive chargeable color toner according to the present invention was manufactured as in Example 1 with the exception of the composition used for manufacturing the mixed powder, which was as follows.

| Composition: | |
|---|---|
| Coloring particles (α) | 100 parts by weight |
| Alumina particles | 3.1 parts by weight |

EXAMPLE 3

A positive chargeable color toner according to the present invention was manufactured as in Example 1 with the exception of the composition used for manufacturing the mixed powder, which was as follows.

| Composition: | |
|---|---|
| Coloring particles (α) | 100 parts by weight |
| Alumina particles | 8.1 parts by weight |

EXAMPLE 4

A mixed powder was obtained by mixing and adhering resin particles onto the outer surfaces of the above mentioned coloring particles (α) of Example 1 in the following composition. The mixing operation was conducted for 5 minutes at 2000 rpm using a 20 liter Henschel mixer.

| Composition: | |
|---|---|
| Coloring particles (α) | 99.0 parts by weight |
| Resin particles | 1.0 parts by weight |

(QP-101N produced by Soken Chemical Industries Co., Ltd. introduced an amino group as the polar group.) (Melt viscosity: $4 \times 10^5$ POISE at 170° C.)

The resin particles were fixed onto the surfaces of the coloring particles by processing the mixed powder obtained in the aforementioned operation for 3 minutes at 6400 rpm, using an "NHS-1-type Nara hybridizer" produced by Nara Machinery Co., Ltd.

Furthermore, 0.4 parts by weight of hydrophobic silica (product name: R-972 produced by Nippon Aerosil Co., Ltd.) was added per 100 parts by weight of the coloring particles obtained following fixing of the resin particles, and this mixture was then agitated for 1 minute at 3000 revolutions per minute using a 10 liter Henschel mixer. In this manner, silica particles were adhered to the surfaces of the toner particles producing the positive chargeable color toner of Example 4 according to the present invention.

EXAMPLE 5

The mixed powder was obtained by the same process as in Example 4 using the following composition.

| Composition: | |
|---|---|
| Coloring particles (α) | 95.0 parts by weight |
| Resin particles | 5.0 parts by weight |

(QP-101N produced by Soken Chemical Industries Co., Ltd. introduced an amino group as the polar group.) (Melt viscosity: $4 \times 10^5$ POISE at 170° C.)

Furthermore, surface reforming was performed on the aforementioned mixed powder using the same process as in Example 4, followed by addition of 0.4 parts by weight of hydrophobic silica (product name: R-972 produced by Nippon Aerosil Co., Ltd.) per 100 parts by weight of the coloring particles obtained following fixing of the resin particles. This mixture was then agitated for 1 minute at 3000 revolutions per minute using a 10 liter Henschel mixer. In this manner, silica particles were adhered to the surfaces of the toner particles producing the positive chargeable color toner of Example 5 according to the present invention.

EXAMPLE 6

The mixed powder was obtained by the same process as in Example 4 using the following composition.

| Composition: | |
|---|---|
| Coloring particles (α) | 92.0 parts by weight |
| Resin particles | 8.0 parts by weight |

(QP-101N produced by Soken Chemical Industries Co., Ltd. introduced an amino group as the polar group.) (Melt viscosity: $4 \times 10^5$ POISE at 170° C.)

Furthermore, surface reforming was performed on the aforementioned mixed powder using the same process as in Example 4, followed by addition of 0.4 parts by weight of hydrophobic silica (product name: R-972 produced by Nippon Aerosil Co., Ltd.) per 100 parts by weight of the coloring particles obtained following fixing of the resin particles. This mixture was then agitated for 1 minute at 3000 revolutions per minute using a 10 liter Henschel mixer. In this manner, silica particles were adhered to the surfaces of the toner particles producing the positive chargeable color toner of Example 6 according to the present invention.

COMPARATIVE EXAMPLE 1

Using the coloring particles (α) manufactured in Example 1, 0.4 parts by weight of hydrophobic silica (product name: R-972 produced by Nippon Aerosil Co., Ltd.) was added per 100 parts by weight of the aforementioned coloring particles (α), and this mixture was then agitated for 1 minute at 3000 revolutions per minute using a 10 liter Henschel mixer. In this manner, silica particles were adhered to the surfaces of the toner particles producing a positive chargeable color toner for comparative use.

COMPARATIVE EXAMPLE 2

Using the coloring particles (α) of Example 1, without mixing therein alumina particles or resin particles, 0.4 parts by weight of hydrophobic silica (product name: R-972 produced by Nippon Aerosil Co., Ltd.) was added per 100 parts by weight of the coloring particles obtained by conducting surface reforming as in Example 1, and this mixture was then agitated for 1 minute at 3000 revolutions per minute using a 10 liter Henschel mixer. In this manner, silica particles were adhered to the surfaces of the toner particles producing a positive chargeable color toner for comparative use.

COMPARATIVE EXAMPLE 3

A positive chargeable color toner for comparative use was manufactured as in Example 1 with the exception of the composition used for manufacturing the mixed powder, which was as follows.

| Composition: | |
|---|---|
| Coloring particles (α) | 100 parts by weight |
| Alumina particles | 17.6 parts by weight |

COMPARATIVE EXAMPLE 4

A positive chargeable color toner for comparative use was manufactured as in Example 1 with the exception that alumina particles with a $CO_2$ gas adsorption number of 5.1/nm$^2$ and a specific surface area of 92 m$^2$/g according to the BET equation were used in place of the previous alumina particles used for manufacturing the mixed powder.

COMPARATIVE EXAMPLE 5

A positive chargeable color toner for comparative use was manufactured as in Example 1 with the exception that alumina particles with a $CO_2$ gas adsorption number of 4.4/nm$^2$ and a specific surface area of 10 m$^2$/g according to the BET equation were used in place of the previous alumina particles used for manufacturing the mixed powder.

COMPARATIVE EXAMPLE 6

A mixed powder of the following composition was obtained using the same process as in Example 4.

| Composition: | |
|---|---|
| Coloring particles (α) | 100 parts by weight |
| Resin particles | 43 parts by weight |

(QP-101N produced by Soken Chemical Industries Co., Ltd. introduced an amino group as the polar group.) (Melt viscosity: 4 × 10$^5$ POISE at 170° C.)

Surface reforming was performed on the aforementioned mixed powder using the same process as in Example 4, followed by addition of 0.4 parts by weight of hydrophobic silica (product name: R-972 produced by Nippon Aerosil Co., Ltd.) was per 100 parts by weight of the coloring particles obtained following fixing of the resin particles. This mixture was then agitated for 1 minute at 3000 revolutions per minute using a 10 liter Henschel mixer. In this manner, silica particles were adhered to the surfaces of the toner particles producing a positive chargeable color toner for comparative use.

A two-component developer was manufactured by mixing a carrier with each of the positive chargeable color toners in the aforementioned Example 1~6 and Comparative Examples 1~6 in the following composition.

| Composition: | |
|---|---|
| Color toner | 5.5 parts by weight |
| Silicon-coated ferrite carrier | 94.5 parts by weight |

(FSL96-2535 produced by Powder Tech Co., Ltd. Carrier current value: 1.0 μA)

The two-component developers for use in positive chargeable coloring were formed by performing mixing operations for 30 minutes using a "V-type mixer (W-3 model)" produced by Tsutsui Rikagaku Kikai Co., Ltd.

The two-component developers using the positive chargeable color toners in Examples 1~6 and Comparative Examples 1~6 formed as described above (heretofore, referred to as "Developers 1~6" and "Comparative Developers 1~6") were tested at 5000 sheets under the following conditions.

| | |
|---|---|
| Normal-temperature/normal-humidity (referred to as "N/N") | 25° C./60% RH |
| High-temperature/high-humidity (referred to as "H/H") | 35° C./85% RH |
| Low-temperature/low-humidity (referred to as "L/L") | 10° C./20% RH |

These results are shown in Table 1.

The copy machine used in the testing was an SF-8300 Copier manufactured by Sharp Corporation. In the Table, the triboelectric charge amount was measured using a charge measuring apparatus Blow Off manufactured by Toshiba Chemical Co, Ltd.; the image density was measured using an reflection densitometer RD-914 manufactured by Macbeth Co., Ltd.; and fog density (fogging) was measured using a color-difference meter TC-60S manufactured by Nihon Denshoku Co., Ltd. Toner scattering was measured by visual observation of the amount of toner scattering around the developing machine. Criterion for evaluation was as follows:

○=No toner scattering

Δ=Small amount of toner scattering

X=Large amount of toner scattering

TABLE 1

| Sample | Characteristics | Initial Copied Sheet Condition N/N | L/L | H/H | 5000th Copied Sheet Condition N/N | L/L | H/H |
|---|---|---|---|---|---|---|---|
| Developer 1 | Triboelectric Charge Amount (μc/g) | 18.4 | 19.8 | 16.8 | 19.1 | 20.3 | 17.2 |
| | Image Density | 1.42 | 1.40 | 1.45 | 1.41 | 1.41 | 1.46 |
| | Fog Density | 0.001 | 0.001 | 0.002 | 0.002 | 0.001 | 0.002 |
| | Toner Scattering | ○ | ○ | ○ | ○ | ○ | ○ |
| Developer 2 | Triboelectric Charge Amount (μc/g) | 21.5 | 22.7 | 21.7 | 22.3 | 23.5 | 22.1 |
| | Image Density | 1.40 | 1.39 | 1.43 | 1.42 | 1.41 | 1.45 |
| | Fog Density | 0.001 | 0.001 | 0.001 | 0.001 | 0.001 | 0.002 |
| | Toner Scattering | ○ | ○ | ○ | ○ | ○ | ○ |
| Developer 3 | Triboelectric Charge Amount (μc/g) | 23.8 | 24.3 | 23.6 | 23.3 | 24.2 | 25.2 |
| | Image Density | 1.37 | 1.35 | 1.39 | 1.38 | 1.38 | 1.40 |

TABLE 1-continued

| Sample | Characteristics | Initial Copied Sheet Condition N/N | L/L | H/H | 5000th Copied Sheet Condition N/N | L/L | H/H |
|---|---|---|---|---|---|---|---|
| | Fog Density | 0.001 | 0.001 | 0.001 | 0.001 | 0.001 | 0.001 |
| | Toner Scattering | ○ | ○ | ○ | ○ | ○ | ○ |
| Developer 4 | Triboelectric Charge Amount (μc/g) | 19.4 | 20.6 | 18.9 | 20.0 | 21.2 | 18.5 |
| | Image Density | 1.45 | 1.43 | 1.46 | 1.43 | 1.41 | 1.44 |
| | Fog Density | 0.002 | 0.001 | 0.002 | 0.002 | 0.001 | 0.003 |
| | Toner Scattering | ○ | ○ | ○ | ○ | ○ | ○ |
| Developer 5 | Triboelectric Charge Amount (μc/g) | 21.8 | 22.4 | 21.1 | 21.9 | 23.6 | 21.7 |
| | Image Density | 1.42 | 1.40 | 1.44 | 1.41 | 1.41 | 1.43 |
| | Fog Density | 0.002 | 0.001 | 0.002 | 0.001 | 0.001 | 0.003 |
| | Toner Scattering | ○ | ○ | ○ | ○ | ○ | ○ |
| Developer 6 | Triboelectric Charge Amount (μc/g) | 23.5 | 24.8 | 22.5 | 23.0 | 24.8 | 23.9 |
| | Image Density | 1.39 | 1.37 | 1.40 | 1.41 | 1.39 | 1.44 |
| | Fog Density | 0.001 | 0.001 | 0.001 | 0.001 | 0.001 | 0.002 |
| | Toner Scattering | ○ | ○ | ○ | ○ | ○ | ○ |
| Comparative Developer 1 | Triboelectric Charge Amount (μc/g) | 6.5 | 7.9 | 4.5 | 5.4 | 5.8 | 4.2 |
| | Image Density | 1.20 | 1.10 | 1.22 | 1.08 | 0.94 | 1.00 |
| | Fog Density | 0.022 | 0.035 | 0.045 | 0.055 | 0.044 | 0.049 |
| | Toner Scattering | X | Δ | X | X | X | X |
| Comparative Developer 2 | Triboelectric Charge Amount (μc/g) | 7.8 | 10.2 | 5.7 | 8.2 | 9.9 | 6.3 |
| | Image Density | 1.12 | 1.06 | 1.14 | 1.00 | 0.90 | 1.03 |
| | Fog Density | 0.016 | 0.025 | 0.037 | 0.032 | 0.036 | 0.041 |
| | Toner Scattering | Δ | Δ | X | X | X | X |
| Comparative Developer 3 | Triboelectric Charge Amount (μc/g) | 36.3 | 40.4 | 38.8 | 40.7 | 45.9 | 43.7 |
| | Image Density | 0.69 | 0.44 | 0.76 | 0.51 | 0.32 | 0.61 |
| | Fog Density | 0.002 | 0.004 | 0.007 | 0.055 | 0.046 | 0.077 |
| | Toner Scattering | ○ | ○ | ○ | X | X | X |
| Comparative Developer 4 | Triboelectric Charge Amount (μc/g) | 18.0 | 20.5 | 13.9 | 19.2 | 23.4 | 13.5 |
| | Image Density | 1.40 | 1.39 | 1.43 | 1.41 | 1.37 | 1.41 |
| | Fog Density | 0.001 | 0.001 | 0.009 | 0.005 | 0.003 | 0.031 |
| | Toner Scattering | Δ | ○ | X | X | Δ | X |
| Comparative Developer 5 | Triboelectric Charge Amount (μc/g) | 17.8 | 18.1 | 15.7 | 15.1 | 17.3 | 12.1 |
| | Image Density | 1.40 | 1.38 | 1.45 | 1.39 | 1.39 | 1.43 |
| | Fog Density | 0.002 | 0.002 | 0.008 | 0.006 | 0.005 | 0.041 |
| | Toner Scattering | X | Δ | X | X | X | X |
| Comparative Developer 6 | Triboelectric Charge Amount (μc/g) | 40.1 | 45.1 | 39.5 | 45.3 | 51.1 | 42.3 |
| | Image Density | 0.78 | 0.55 | 0.88 | 0.55 | 0.40 | 0.61 |
| | Fog Density | 0.001 | 0.001 | 0.002 | 0.036 | 0.023 | 0.046 |
| | Toner Scattering | ○ | ○ | ○ | X | X | X |

As seen from the results of Table 1, in Examples 1~6 according to the present invention, the image density is acceptable for practical use, and there is little fogging as well as no generation of toner scattering. In contrast, in Comparative Examples 1~6, toner scattering occurred after the 5000 sheets, image quality and density were reduced, and fogging was confirmed in the high-temperature/high-humidity (H/H) and low-temperature/-low-humidity (L/L) environments.

According to the present invention, by means of fixing a specific alumina particle or resin particle onto the surface of a coloring particle, a positive chargeable color toner possessing superior positive charging properties, image quality and resistance to the environment in addition to a sufficient image density, is obtainable in which there is little fogging and scattering of the toner. In addition, because superior charging properties, in other words uniformly stable positive charging properties at an appropriate charge amount level, are obtainable due to the structure of the present invention, the charging properties of the binding resin and coloring agent, both of which were main concerns in quality planning of prior art color toners, can be, for the most par, ignored. As a result, the allowable range for selection of these materials has been greatly expanded, thus easing the burden of selection.

The present invention has been described in detail with respect to examples, and it should now be apparent from the foregoing, to those skilled in the art, that changes and modifications may be made without departing from the invention in its broader aspects, and it is the intention, therefore, in the appended claims to cover all such changes and modifications that fall within the true spirit of the invention.

What is claimed is:

1. A positive chargeable color toner comprising (a) a positive chargeable compound and (b) coloring particles comprising a binding resin, a coloring agent and a charge control agent, said coloring particles having surfaces to which is fixed said positive chargeable compound in the amount of 0.1~10.0 parts by weight per 100 parts by weight of said coloring particles, said positive chargeable compound comprising alumina particles which have been treated with a silane coupling agent selected from the group consisting of dimethyl silicone and $C_8F_{17}SO_2NC_2H_5(CH_2)_3Si(CH_3O)_3$, said alumina particles having a $CO_2$ gas adsorption number of $4.0/nm^2$ or less and a specific surface area of $80\ m^2/g$ or greater.

2. A positive chargeable color toner comprising (a) a positive chargeable compound and (b) coloring particles comprising a binding resin, a coloring agent and a charge control agent, said coloring particles having surfaces to which is fixed said positive chargeable compound in the amount of 0.1~10.0 parts by weight per 100 parts by weight of said coloring particles, said positive chargeable resin particles containing a polar group and possessing thermoplasticity and an average particle size of 0.05~2.0 μm, said positive chargeable color toner possessing melt viscosity characteristics inside a region designated by lines connecting (a), (b), (c) and (d) in a graph relating applied temperature and melt viscosity as follows: (a) $3\times10^6$ POISE at 85° C., (b) $5\times10^4$ POISE at 120° C., (c) $5\times10^4$ POISE at 205° C., (d) $3\times10^6$ POISE at 170° C.

3. A positive chargeable color toner as recited in claim 1 wherein binding resin comprises at least one resin selected from the group consisting of polyester resin, styrene resin, acrylate resin, styrene-acrylate copolymer resin, vinyl chloride resin, vinyl acetate resin, vinylidene chloride resin, phenol resin, epoxy resin, thermoplastic epoxy resin, polypropylene resin, and polyethylene resin.

4. A positive chargeable color toner as recited in claim 3 wherein said binding resin is a polyester resin.

5. A positive chargeable color toner as recited in claim 1 wherein said coloring agent comprises at least one compound selected from the group consisting of rhodamine-type magenta dye, quinacridone-type magenta pigment, phthalocyanine-type cyanogen pigment, phthalocyanine-type green pigment, disazo-type yellow pigment, monoazo-type red pigment, and anthraquinone-type dye.

6. A positive chargeable color toner as recited in claim 1 wherein 2~15 parts by weight of said coloring agent is incorporated per 100 parts by weight of said binding resin.

7. A positive chargeable color toner as recited in claim 1 wherein said charge control agent is quaternary ammonium salt.

8. A positive chargeable color toner as recited in claim 4 wherein said polyester resin is obtained from the condensation polymerization of an alcohol and a carboxylic acid.

9. A positive chargeable color toner as recited in claim 8 wherein said alcohol is a bivalent alcohol monomer selected from the group consisting of ethylene glycol, diethylene glycol, triethylene glycol, 1,2-propylene glycol, 1,3-propylene glycol, 1,4-butanediol, neopentyl glycol, 1,4-butenediol, 1,4-bis(hydroxymethylcyclohexane, bisphenol A, polyoxymethylenated bisphenol A, polyoxyethylenated bisphenol A, and polyoxypropylenated bisphenol A; and wherein said carboxylic acid is a bivalent organic acid monomer selected from the group consisting of maleic acid, fumaric acid, mesaconic acid, citraconic acid, itaconic acid, glutaconic acid, phthalic acid, isophthalic acid, terephthalic acid, cyclohexane dicarboxylic acid, succinic acid, adipic acid, sebacic acid, malonic acid, anhydrates of said carboxylic acids, and dimers formed from lower alkylesters and linolenic acids.

10. A positive chargeable color toner as recited in claim 8 wherein said alcohol is a multi-valent alcohol monomer possessing three or more valencies selected from the group consisting of sorbitol, 1,2,3,6-hexane tetrol, 1,4-sorbitane, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene; and wherein said carboxylic acid is a multi-valent carboxylic acid monomer possessing three or more valencies selected from the group consisting of 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-napthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetratricarboxylic acid, and their anhydrates.

* * * * *